US011388931B2

(12) United States Patent
Potter et al.

(10) Patent No.: US 11,388,931 B2
(45) Date of Patent: Jul. 19, 2022

(54) SEALING FOR VAPOR PROVISION SYSTEMS

(71) Applicant: BRITISH AMERICAN TOBACCO (INVESTMENTS) LIMITED, London (GB)

(72) Inventors: Mark Potter, London (GB); Wade Tipton, Cambridgeshire (GB); William Harris, Cambridgeshire (GB); Christopher Rowe, Cambridgeshire (GB); Conor Devine, Cambridgeshire (GB); James Davies, Cambridgeshire (GB); James Boonzaier, Cambridgeshire (GB)

(73) Assignee: Nicoventures Trading Limited, London (GB)

( * ) Notice: Subject to any disclaimer, the term of this patent is extended or adjusted under 35 U.S.C. 154(b) by 120 days.

(21) Appl. No.: 16/644,722

(22) PCT Filed: Sep. 4, 2018

(86) PCT No.: PCT/GB2018/052493
§ 371 (c)(1),
(2) Date: Mar. 5, 2020

(87) PCT Pub. No.: WO2019/048841
PCT Pub. Date: Mar. 14, 2019

(65) Prior Publication Data

US 2020/0281270 A1 Sep. 10, 2020

(30) Foreign Application Priority Data

Sep. 6, 2017 (GB) ..... 1714300

(51) Int. Cl.
*A24F 13/00* (2006.01)
*A24F 17/00* (2006.01)
(Continued)

(52) U.S. Cl.
CPC ..... *A24F 40/44* (2020.01); *A24F 40/46* (2020.01); *A24F 40/485* (2020.01); *A24F 40/10* (2020.01); *A24F 40/70* (2020.01)

(58) Field of Classification Search
CPC ..... A24F 40/44; A24F 40/10; A24F 40/46; A24F 40/485
See application file for complete search history.

(56) References Cited

U.S. PATENT DOCUMENTS 10,285,444 B2 * 5/2019 Clemens ..... A24F 40/44
2014/0238423 A1 8/2014 Tucker
(Continued)

FOREIGN PATENT DOCUMENTS

CN 204232294 4/2015
EP 3015010 5/2016
(Continued)

OTHER PUBLICATIONS

International Preliminary Report on Patentability, Application No. PCT/GB2018/052493, dated Mar. 10, 2020, 8 pages.
(Continued)

*Primary Examiner* — Abdullah A Riyami
*Assistant Examiner* — Thang H Nguyen
(74) *Attorney, Agent, or Firm* — Patterson Thuente Pedersen PA

(57) ABSTRACT

A vapor provision system includes a reservoir containing liquid for vaporization; a vaporizer; a liquid transport element arranged to transport liquid from the reservoir to the vaporizer for vaporization, wherein the liquid transport element extends into the reservoir through an opening in a wall of the reservoir; and a collar mounted around the liquid transport element where it passes through the opening in the wall of the reservoir.

20 Claims, 7 Drawing Sheets

(51) Int. Cl.

| | |
|---|---|
| ***A24F 25/00*** | (2006.01) |
| ***A24F 40/44*** | (2020.01) |
| ***A24F 40/485*** | (2020.01) |
| ***A24F 40/46*** | (2020.01) |
| *A24F 40/70* | (2020.01) |
| *A24F 40/10* | (2020.01) |

(56) References Cited

U.S. PATENT DOCUMENTS

| | | | | |
|---|---|---|---|---|
| 2016/0073692 | A1* | 3/2016 | Alarcon | A24F 40/40 131/329 |
| 2016/0109115 | A1* | 4/2016 | Lipowicz | H05B 3/0014 392/395 |
| 2016/0128386 | A1 | 5/2016 | Zhiping | |
| 2017/0006922 | A1* | 1/2017 | Wang | H05B 3/46 |
| 2020/0260794 | A1* | 8/2020 | Angell | A24F 40/44 |

FOREIGN PATENT DOCUMENTS

| | | | |
|---|---|---|---|
| EP | 3153037 | | 4/2017 |
| RU | 2608289 | C2 | 1/2017 |
| RU | 2627004 | C2 | 8/2017 |
| WO | WO-2013116565 | A1 | 8/2013 |
| WO | WO-2013116567 | A1 | 8/2013 |
| WO | WO-2016012795 | A1 | 1/2016 |
| WO | WO 2016/061166 | | 4/2016 |

OTHER PUBLICATIONS

International Search Report and Written Opinion, Application No. PCT/GB2018/052493, dated Nov. 23, 2018, 14 pages.

Office Action and Search Report dated Aug. 31, 2020 for Russian Application No. 2020109762, filed Sep. 4, 2018, 9 pages.

* cited by examiner

SEALING FOR VAPOR PROVISION SYSTEMS

PRIORITY CLAIM

The present application is a National Phase entry of PCT Application No. PCT/GB2018/052493, filed Sep. 4, 2018, which claims priority from GB Patent Application No. 1714300.9, filed Sep. 6, 2017, each which is hereby fully incorporated herein by reference.

FIELD

The present disclosure relates to vapor provision systems such as nicotine delivery systems (e.g. electronic cigarettes and the like).

BACKGROUND

Electronic vapor provision systems such as electronic cigarettes (e-cigarettes) generally contain a vapor precursor material, such as a reservoir of a source liquid containing a formulation, typically including nicotine, from which a vapor is generated for inhalation by a user, for example through heat vaporization. Thus, a vapor provision system will typically comprise a vapor generation chamber containing a vaporizer, e.g. a heating element, arranged to vaporize a portion of precursor material to generate a vapor in the vapor generation chamber. As a user inhales on the device and electrical power is supplied to the vaporizer, air is drawn into the device through an inlet hole and into the vapor generation chamber where the air mixes with vaporized precursor material to form a condensation aerosol. There is an air channel connecting the vapor generation chamber and an opening in the mouthpiece so the air drawn through the vapor generation chamber as a user inhales on the mouthpiece continues along the flow path to the mouthpiece opening, carrying the vapor with it for inhalation by the user.

For electronic cigarettes using a liquid vapor precursor (e-liquid) there is a risk of the liquid leaking. This is the case for liquid-only electronic cigarettes and hybrid devices (electronic cigarettes with tobacco or another flavor element separate from the vapor generation region). Liquid-based e-cigarettes will typically have a capillary wick for transporting liquid from within a liquid reservoir to a vaporizer located in the air channel connecting from the air inlet to the vapor outlet for the e-cigarette. Thus the wick typically passes through an opening in a wall that separates the liquid reservoir from the air channel in the vicinity of the vaporizer.

FIG. 1 schematically shows a cross-section of a portion of a conventional electronic cigarette in the vicinity of its vapor generation chamber 2, i.e. where vapor is generated during use. The electronic cigarette comprises a central air channel 4 through a surrounding annular liquid reservoir 6. The annular liquid reservoir 6 is defined by an inner wall 8 and an outer wall 10, which may both be cylindrical (the inner wall 8 separates the liquid reservoir 6 from the air channel, and so in that sense the inner wall 8 also defines the air channel). The electronic cigarette comprises a vaporizer 12 in the form of a resistive heating coil. The coil 12 is wrapped around a capillary wick 14. Each end of the capillary wick 14 extends into the liquid reservoir 6 through an opening 16 in the inner wall 8. The wick 14 is thus arranged to convey liquid from within the liquid reservoir 6 to the vicinity of the coil 12 by capillary action. During use an electric current is passed through the coil 12 so that it is heated and vaporizes a portion of liquid from the capillary wick 14 adjacent the coil 12 to generate vapor in the vapor generation chamber 2 for user inhalation. The vaporized liquid is then replaced by more liquid being drawn along the wick 14 from the liquid reservoir 6 by capillary action.

Because the reservoir inner wall 8 has openings 16 to allow liquid to be drawn out of the reservoir 6 to the vaporizer 12, there is a corresponding risk of leakage from this part of the electronic cigarette. Leakage is undesirable both from the perspective of the end user naturally not wanting to get the e-liquid on their hands or other items, and also from a reliability perspective, since leakage has the potential to damage the electronic cigarette itself, for example due to corrosion of components which are not intended to come into contact the liquid.

To help minimize the risk of leakage from the openings 16 in the approach of FIG. 1, the size of the openings 16 should closely correspond to the size of the wick 14 so the wick in effect blocks the openings. Typically it will be desired for the wick to be slightly compressed where it passes through the openings 16 to help form this seal. If the openings 16 are too large for the wick 14, the resulting gaps between the wick and the inner walls of the respective openings can allow liquid to leak from the reservoir through these gaps. Conversely, if the openings 16 are too small for the wick, the wick may be unduly compressed, and this can impact its wicking ability and result in insufficient liquid being supplied to the vaporizer during use, which can give rise to overheating and undesirable flavors (drying out).

It is not straightforward to ensure there is a good match between the size of the openings 16 and the size of the wick 14 where it passes through the openings. For example, from a manufacturing perspective, electronic cigarettes are mass produced items and the openings themselves are often defined by how multiple components fit together, and this means manufacturing and assembly variations can impact how reliably the size of openings can be reproduced from device to device. What is more, the geometry of the wicks themselves can be variable. For example, a wick will often comprise a bundle of fibers twisted together, for example glass fibers or organic cotton fibers, and this naturally means the outer profile of the wick is subject to variation, both along its length, and from wick to wick. Consequently, with the approach of FIG. 1, it is not always possible to reliably achieve the desired degree of sealing between the wick 14 and the openings 60 in the wall 8 of the reservoir 6. This can result in some devices having an increased risk of leakage (where openings are too large relative to the wick) and some devices having an increased risk of insufficient wicking/dry-out (where openings are too small relative to the wick).

Various approaches are described herein which seek to help address or mitigate at least some of the issues discussed above.

SUMMARY

According to a first aspect of certain embodiments there is provided a vapor provision system comprising: a reservoir containing liquid for vaporization; a vaporizer; a liquid transport element arranged to transport liquid from the reservoir to the vaporizer for vaporization to generate a vapor for user inhalation, wherein the liquid transport element extends into the reservoir through an opening in a wall of the reservoir; and a collar mounted around the liquid transport element where it passes through the opening in the wall of the reservoir.

According to another aspect of certain embodiments there is provided vapor provision means comprising: reservoir means for containing liquid for vaporization; vaporizer means; liquid transport means for transporting liquid from the reservoir means to the vaporizer means for vaporization to generate a vapor for user inhalation, wherein the liquid transport means extends into the reservoir means through opening means in a wall of the reservoir means; and collar means mounted around the liquid transport means where it passes through the opening means in the wall of the reservoir means.

According to another aspect of certain embodiments there is provided a method of assembling a vapor provision system, comprising: providing a liquid transport element; mounting a collar around the liquid transport element; providing a reservoir for containing liquid for vaporization; and arranging the liquid transport element so it extends into the reservoir through an opening in a wall of the reservoir such that the collar is mounted to the liquid transport element where the liquid transport element passes through the opening in the wall of the reservoir.

It will be appreciated that features and aspects of the disclosure described herein in relation to the first and other aspects of the disclosure are equally applicable to, and may be combined with, embodiments of the disclosure according to other aspects of the disclosure as appropriate, and not just in the specific combinations described above.

BRIEF DESCRIPTION OF THE DRAWINGS

Embodiments of the disclosure will now be described, by way of example only, with reference to the accompanying drawings, in which.

DETAILED DESCRIPTION

Figure 1:
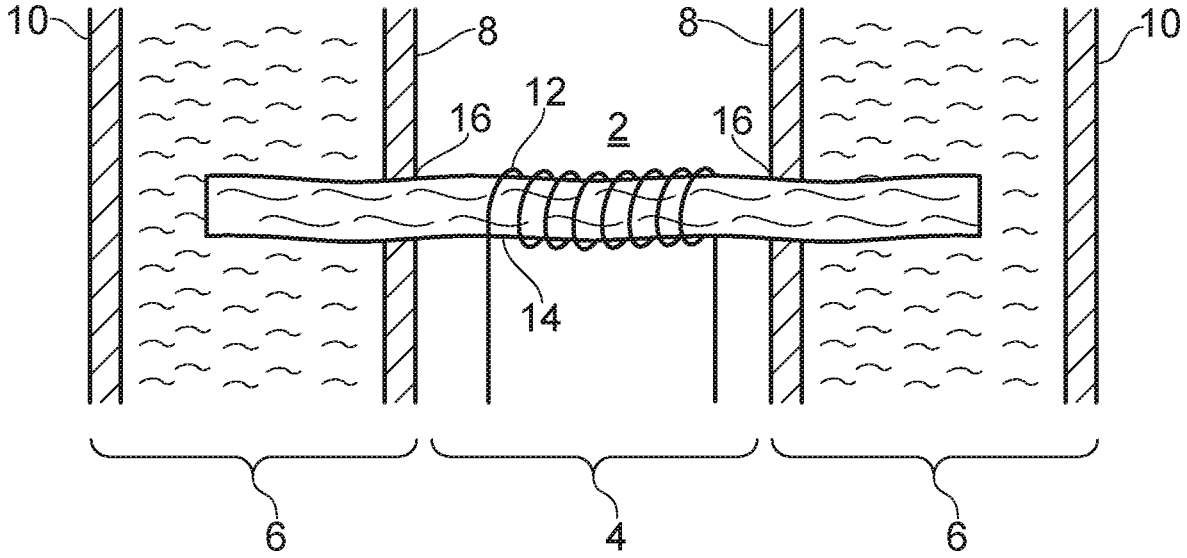
FIG. 1 PRIOR ART
FIG. 1 represents in schematic cross-section a vapor generation region of a conventional vapor provision system.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

The present disclosure relates to vapor provision systems, which may also be referred to as aerosol provision systems, such as e-cigarettes. Throughout the following description the term "e-cigarette" or "electronic cigarette" may sometimes be used, but it will be appreciated this term may be used interchangeably with vapor provision system/device and electronic vapor provision system/device. Furthermore, and as is common in the technical field, the terms "vapor" and "aerosol", and related terms such as "vaporize", "volatilize" and "aerosolize", may generally be used interchangeably.

Vapor provision systems (e-cigarettes) often, though not always, comprise a modular assembly including both a reusable part (control unit part) and a replaceable (disposable) cartridge part. Often the replaceable cartridge part will comprise the vapor precursor material and the vaporizer and the reusable part will comprise the power supply (e.g. rechargeable battery) and control circuitry. It will be appreciated these different parts may comprise further elements depending on functionality. For example, the reusable device part may comprise a user interface for receiving user input and displaying operating status characteristics, and the replaceable cartridge part may comprise a temperature sensor for helping to control temperature. Cartridges are electrically and mechanically coupled to a control unit for use, for example using a screw thread, latching or bayonet fixing with appropriately engaging electrical contacts. When the vapor precursor material in a cartridge is exhausted, or the user wishes to switch to a different cartridge having a different vapor precursor material, a cartridge may be removed from the control unit and a replacement cartridge attached in its place. Devices conforming to this type of two-part modular configuration may generally be referred to as two-part devices. It is also common for electronic cigarettes to have a generally elongate shape. For the sake of providing a concrete example, certain embodiments of the disclosure described herein will be taken to comprise this kind of generally elongate two-part device employing disposable cartridges. However, it will be appreciated the underlying principles described herein may equally be adopted for different electronic cigarette configurations, for example single-part devices or modular devices comprising more than two parts, refillable devices and single-use disposable devices, as well as devices conforming to other overall shapes, for example based on so-called box-mod high performance devices that typically have a more box-like shape. More generally, it will be appreciated certain embodiments of the disclosure are based on approaches for seeking to help more reliably form a seal for an opening in a reservoir wall through which a wick passes in accordance with the principles described herein, and other constructional and functional aspects of electronic cigarettes implementing approaches in accordance with certain embodiments of the disclosure are not of primary significance and may, for example, be implemented in accordance with any established approaches.

Figure 2:
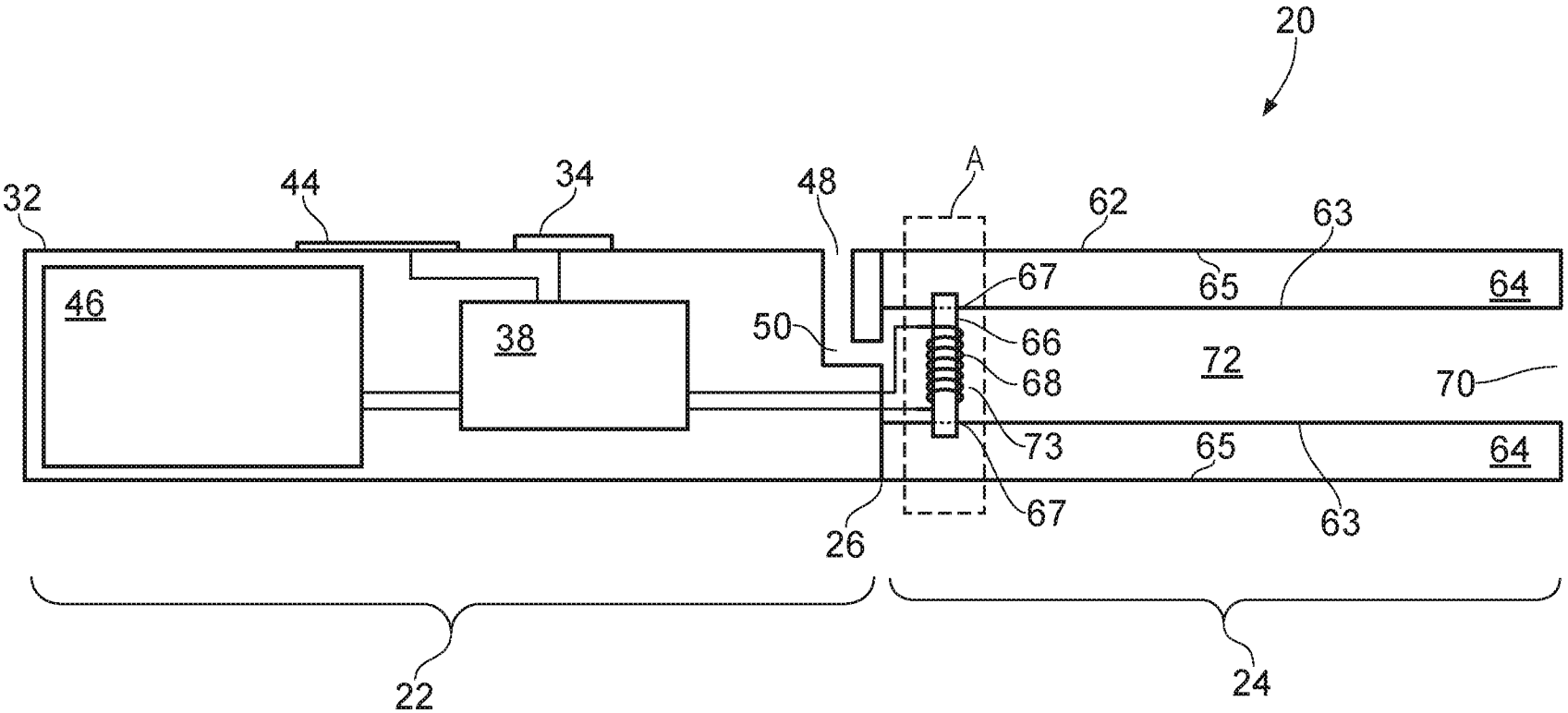
FIG. 2 represents in schematic cross-section a vapor provision system according to certain embodiments of the disclosure.

FIG. 2 is a cross-sectional view through an example e-cigarette 20 in accordance with certain embodiments of the disclosure. The e-cigarette 20 comprises two main components, namely a reusable part 22 and a replaceable/disposable cartridge part 24. In normal use the reusable part 22 and the cartridge part 24 are releasably coupled together at an interface 26. When the cartridge part is exhausted or the user simply wishes to switch to a different cartridge part, the cartridge part may be removed from the reusable part and a replacement cartridge part attached to the reusable part in its place. The interface 26 provides a structural, electrical and air path connection between the two parts and may be established in accordance with conventional techniques, for example based around a screw thread, latch mechanism, or bayonet fixing with appropriately arranged electrical contacts and openings for establishing the electrical connection and air path between the two parts as appropriate. The specific manner in which the cartridge part 24 mechanically couples to the reusable part 22 is not significant to the principles described herein, but for the sake of a concrete example is assumed here to comprise a latching mechanism, for example with a portion of the cartridge being received in a corresponding receptacle in the reusable part with cooperating latch engaging elements (not represented in FIG. 2).

It will also be appreciated the interface 26 in some implementations may not support an electrical and/or air path connection between the respective parts. For example, in some implementations a vaporizer may be provided in the reusable part rather than in the cartridge part, or the transfer of electrical power from the reusable part to the cartridge part may be wireless (e.g. based on electromagnetic induction), so that an electrical connection between the reusable part and the cartridge part is not needed. Furthermore, in some implementations the airflow through the electronic cigarette might not go through the reusable part so that an air path connection between the reusable part and the cartridge part is not needed.

The cartridge part 24 may in accordance with certain embodiments of the disclosure be broadly conventional apart from where modified in accordance with the approaches described herein in accordance with certain embodiments of the disclosure. In FIG. 2, the cartridge part 24 comprises a cartridge housing 62 formed of a plastics material. The cartridge housing 62 supports other components of the cartridge part and provides the mechanical interface 26 with the reusable part 22. The cartridge housing is generally circularly symmetric about a longitudinal axis along which the cartridge part couples to the reusable part 22. In this example the cartridge part has a length of around 4 cm and a diameter of around 1.5 cm. However, it will be appreciated the specific geometry, and more generally the overall shape and materials used, may be different in different implementations.

Within the cartridge housing 62 is a reservoir 64 that contains liquid vapor precursor material. The liquid vapor precursor material may be conventional, and may be referred to as e-liquid. The liquid reservoir 64 in this example has an annular shape which is generally circularly symmetric with an outer wall 65 defined by the cartridge housing 62 and an inner wall 63 that defines an air path 72 through the cartridge part 24. The reservoir 64 is closed at each end by end walls to contain the e-liquid. The reservoir 64 may be formed generally in accordance with conventional manufacturing techniques, for example it may comprise a plastics material and be integrally molded with the cartridge housing 62.

The cartridge part further comprises a wick (liquid transport element) 66 and a heater (vaporizer) 68. In this example the wick 66 extends transversely across the cartridge air path 72 with its ends extending into the reservoir 64 of e-liquid through openings 67 in the inner wall of the reservoir 64. As discussed further herein, in accordance with certain embodiments of the disclosure a collar (not shown in FIG. 2) is mounted around the liquid transport element where it passes through each opening in the wall of the reservoir. The wick 66 and heater 68 are arranged in the cartridge air path 72 such that a region of the cartridge air path 72 around the wick 66 and heater 68 in effect defines a vaporization region 73 for the cartridge part. E-liquid in the reservoir 64 infiltrates the wick 66 through the ends of the wick extending into the reservoir 64 and is drawn along the wick by surface tension/capillary action (i.e. wicking). The heater 68 in this example comprises an electrically resistive wire coiled around the wick 66. In this example the heater 68 comprises a nickel chrome alloy (Cr20Ni80) wire and the wick 66 comprises a glass fiber bundle, but it will be appreciated the specific heater configuration is not significant to the principles described herein. In use electrical power may be supplied to the heater 68 to vaporize an amount of e-liquid (vapor precursor material) drawn to the vicinity of the heater 68 by the wick 66. Vaporized e-liquid may then become entrained in air drawn along the cartridge air path 72 from the vaporization region 73 towards the mouthpiece outlet 70 for user inhalation.

The rate at which e-liquid is vaporized by the vaporizer (heater) 68 will generally depend on the amount (level) of power supplied to the heater 68. Thus electrical power can be applied to the heater 66 to selectively generate vapor from the e-liquid in the cartridge part 24, and furthermore, the rate of vapor generation can be changed by changing the amount of power supplied to the heater 68, for example through pulse width and/or frequency modulation techniques.

The reusable part 22 may be conventional and comprises an outer housing 32 with an opening that defines an air inlet 48 for the e-cigarette, a battery 46 for providing operating power for the electronic cigarette, control circuitry 38 for controlling and monitoring the operation of the electronic cigarette, a user input button 34 and a visual display 44.

The outer housing 32 may be formed, for example, from a plastics or metallic material and in this example has a circular cross-section generally conforming to the shape and size of the cartridge part 24 so as to provide a smooth transition between the two parts at the interface 26. In this example, the reusable part has a length of around 8 cm so the overall length of the e-cigarette when the cartridge part and reusable part are coupled together is around 12 cm. However, and as already noted, it will be appreciated that the overall shape and scale of an electronic cigarette implementing an embodiment of the disclosure is not significant to the principles described herein.

The air inlet 48 connects to an air path 50 through the reusable part 22. The reusable part air path 50 in turn connects to the cartridge air path 72 across the interface 26 when the reusable part 22 and cartridge part 24 are connected together. Thus, when a user inhales on the mouthpiece opening 70, air is drawn in through the air inlet 48, along the reusable part air path 50, across the interface 26, through the vapor generation region in the vapor generation region 73 in the vicinity of the atomizer 68 (where vaporized e-liquid becomes entrained in the air flow), along the cartridge air path 72, and out through the mouthpiece opening 70 for user inhalation.

The battery 46 in this example is rechargeable and may be of a conventional type, for example of the kind normally used in electronic cigarettes and other applications requiring provision of relatively high currents over relatively short periods. The battery 46 may be recharged through a charging connector in the reusable part housing 32, for example a USB connector (not shown).

The user input button 34 in this example is a conventional mechanical button, for example comprising a spring mounted component which may be pressed by a user to establish an electrical contact. In this regard, the input button may be considered an input device for detecting user input and the specific manner in which the button is implemented is not significant. For example, other forms of mechanical button(s) or touch-sensitive button(s) (e.g. based on capacitive or optical sensing techniques) may be used in other implementations.

The display 44 is provided to provide a user with a visual indication of various characteristics associated with the electronic cigarette, for example current power setting information, remaining battery power, and so forth. The display may be implemented in various ways. In this example the display 44 comprises a conventional pixilated LCD screen that may be driven to display the desired information in accordance with conventional techniques. In other implementations the display may comprise one or more discrete indicators, for example LEDs, that are arranged to display the desired information, for example through particular colors and/or flash sequences. More generally, the manner in which the display is provided and information is displayed to a user using the display is not significant to the principles described herein. For example, some embodiments may not include a visual display and may include other means for providing a user with information relating to operating characteristics of the electronic cigarette, for example using audio signaling or haptic feedback, or may not include any means for providing a user with information relating to operating characteristics of the electronic cigarette.

The control circuitry 38 is suitably configured/programmed to control the operation of the electronic cigarette to provide functionality in accordance with the established techniques for operating electronic cigarettes. For example, the control circuitry 38 may be configured to control a supply of power from the battery 46 to the heater/vaporizer 68 to generate vapor from a portion of the e-liquid in the cartridge part 24 for user inhalation via the mouthpiece outlet 70 in response to user activation of the input button 34, or in other implementations in response to other triggers, for example in response to detecting user inhalation. As is conventional, the control circuitry (processor circuitry) 38 may be considered to logically comprise various sub-units/circuitry elements associated with different aspects of the electronic cigarette's operation, for example user input detection, power supply control, display driving, and so on. It will be appreciated the functionality of the control circuitry 38 can be provided in various different ways, for example using one or more suitably programmed programmable computer(s) and/or one or more suitably configured application-specific integrated circuit(s)/circuitry/chip(s)/chipset(s) to provide the desired functionality.

The vapor provision system/electronic cigarette represented in FIG. 2 differs from conventional electronic cigarettes in the manner in which the liquid transport element/wick 66 couples into the reservoir 64 containing liquid for vaporization. In particular, in accordance with certain embodiments of the disclosure, the liquid transport element extends into the reservoir through an opening in a wall of the reservoir and has a collar mounted around the liquid transport element where it passes through the opening in the wall of the reservoir. Providing a collar around the wick is proposed to help with sealing the openings in the wall of the reservoir through which the wick passes. In particular, the collar may add rigidity to the wick so that the opening in the reservoir wall may be configured to press against the collar to help with providing a seal with a reduced risk of overly compressing the wick itself, for example in an electronic cigarette in which the size of the opening is at the smaller end of the tolerance range. Because of this, the nominal size of the opening may be made smaller than it might otherwise be for a simple wick having the same size as the collar. Furthermore, because the collar may comprise a single element, the size of the through hole that the wick passes through is not reliant on how multiple separate parts fit together and so maybe more reliably formed to suit the diameter of the wick (i.e. so the wick forms a snug fit within the collar through-hole). In some cases the collar may be an element which is mounted to the wick during parts assembly, and in other cases the collar may in fact be integrally formed with the wick, for example through a molding process. That is to say, in some example implementations, the collar may be a molded element, and may be molded with the wick in place.

Figure 3:
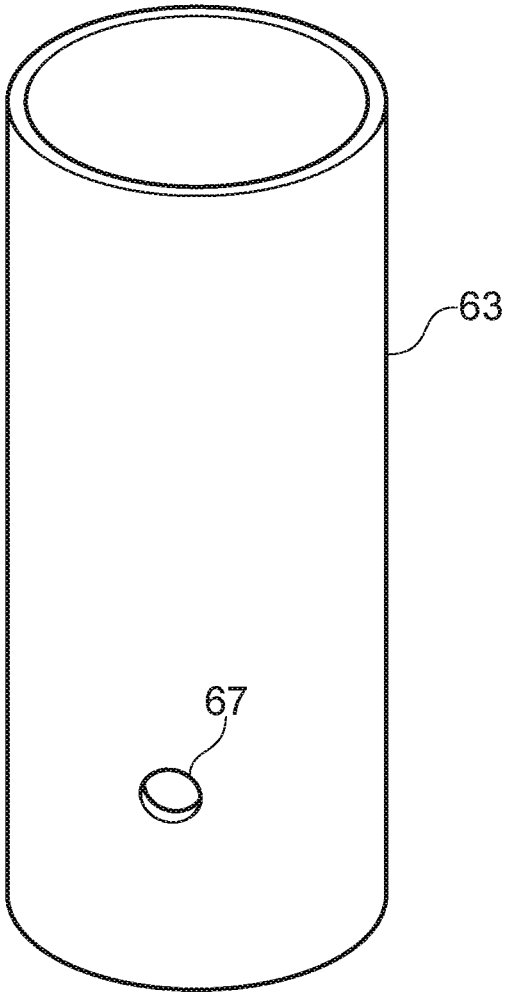
FIGS. 3 to 5 represent schematic perspective views of liquid reservoir wall configurations for vapor provision systems according to various embodiments of the disclosure.

FIG. 3 schematically represents one example approach for providing the inner wall 63 of the electronic cigarette 20 represented in FIG. 2. In this example the wall comprises a single piece tube with openings 67 in the appropriate places. In this example the openings 67 may be made by drilling through the tube comprising the inner wall 63 or by other means. The tube may, for example, be formed of a plastics material, a rubber material, e.g., silicone, glass or metal. During assembly the wick and collar assembly may be threaded through the openings. In a variation on this approach, the inner wall 63 may comprise a slit on one side from one opening to the other. This slit may then be pulled open during assembly to allow the wick and collar assembly to be slid into place, and then the slit closed when the wick and collar assembly is in place. With this approach it may be appropriate to provide some form of sealing for the slit when the wick and collar assembly is in place (e.g. adhesive tape over the slip).

Figure 4A:
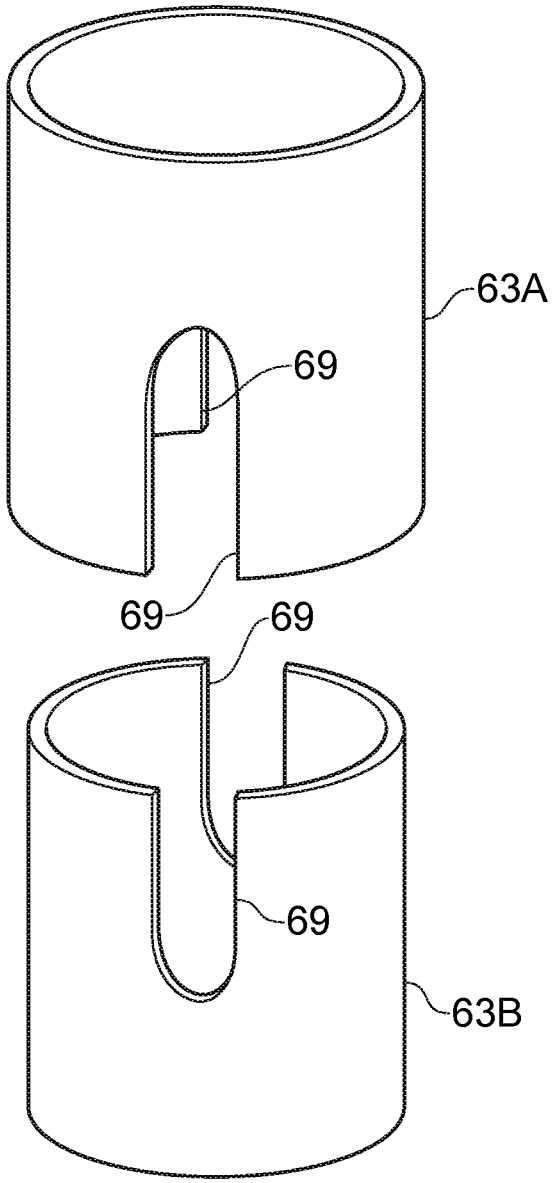
Figure 4B:
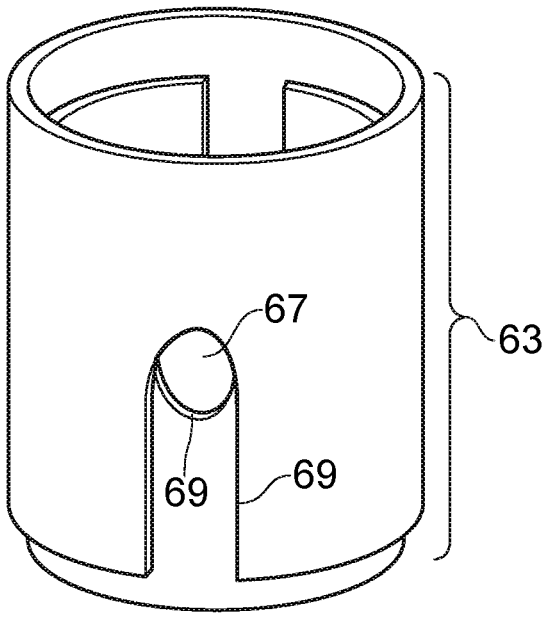

FIGS. 4A and 4B schematically represent another example approach for providing the inner wall 63 of the electronic cigarette 20 represented in FIG. 2. In this example the inner wall comprises two components, namely an upper component 63A and a lower component 63B. FIG. 4A schematically represents the upper and lower components when separated prior to assembly and FIG. 4B schematically represents the upper and lower components when coupled together for use in the electronic cigarette 20. The upper and lower components 63A, 63B are both in the form of a tube with the lower component being sized to provide an interference fit to the inside of the upper component so that they may be assembled as represented in FIG. 4B. As can be seen in the figures, each component has a pair of slots 69 which cooperate with the corresponding slots on the other component to form the openings 67 when assembled as seen in FIG. 4B. The inner wall components 63A, 63B may, for example, be formed of a plastics material, rubber, silicone, glass or metal, for example. During assembly the wick and collar assembly may be simply located at the ends of the slots in one component before coupling to the other component.

Figure 5:
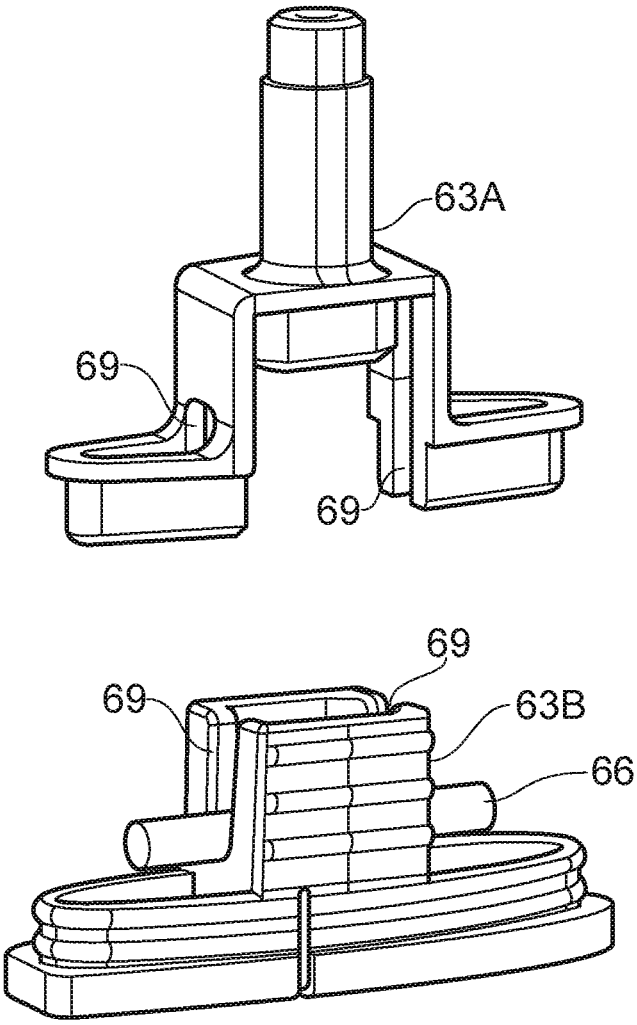

FIG. 5 schematically represents yet another example approach for providing the inner wall 63 of the electronic cigarette 20 represented in FIG. 2. The example represented in FIG. 5 is based on the same underlying principles as the example represented in FIGS. 4A and 4B, but differs in terms of the overall shape of the components. For example, the arrangement in FIG. 5 may be better suited to a relatively flat electronic cigarette rather than a generally tubular electronic cigarette. Thus, in the example of FIG. 5 the inner wall 63 is again provided by two components, namely an upper component 63A and a lower component 63B. FIG. 5 schematically represents the upper and lower components when separated prior to assembly. In this example the upper component 63A comprises a rigid structure, for example formed of a plastics material, and the lower component 63B comprises a resilient structure, for example formed of silicone. As for the example in FIGS. 4A and 4B, each component in FIG. 5 has a pair of slots 69 which cooperate with the corresponding slots in the other component to form openings when assembled. In FIG. 5 the wick 66 it shown in place in the lower component 63B. During assembly the wick and collar assembly may be simply located at the bottom of the slots in one component, such as shown in FIG. 5, before coupling to the other component.

In general, it will be appreciated the specific manner in which the inner wall 63 and its openings 67 are provided is not of primary significance to the principles described herein, and openings through which the wick extends where it enters the liquid reservoir may be provided differently in different implementations. Furthermore, it will be appreciated that whereas in the examples described herein the wick is assumed to have both ends extending into the liquid reservoir, it will be appreciated the same principles may be applied in respect of a wick having only one end extending into a liquid reservoir, or indeed a wick having multiple arms (e.g. a cross-like form) with more than two ends extending into a liquid reservoir.

A number of example approaches for providing a collar around a wick (liquid transport element) in accordance with various different embodiments of the disclosure will now be described with reference to FIGS. 6 to 9 with various functionally corresponding elements in the different embodiments being identified by the same reference numerals. Any of these embodiments may be implemented in the example electronic cigarette 20 represented in FIG. 2, or indeed in any other form of electronic cigarette in which a liquid transport element extends into a liquid reservoir through a wall of the liquid reservoir.

Figure 6:
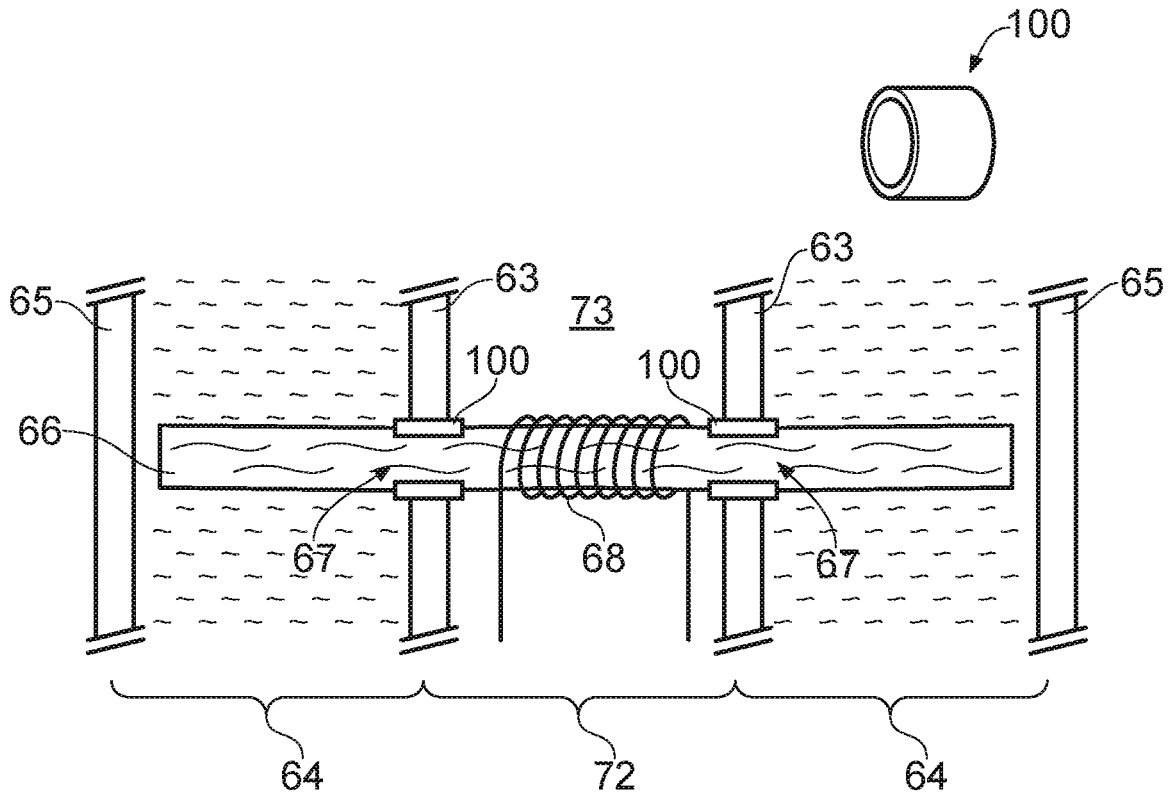
FIGS. 6 to 9 represent in schematic cross-section vapor generation regions of vapor provision systems according to various embodiments of the disclosure.

FIG. 6 schematically shows a cross-section of a portion of the electronic cigarette/vapor provision system 20 in the vicinity of its vapor generation chamber 73, i.e. where vapor is generated during use, in accordance with a first example embodiment.

Broadly speaking, the portion of the electronic cigarette 20 represented in FIG. 6 corresponds to that part identified by the dashed-box labelled A in FIG. 2. Thus, and as represented in FIG. 6, this portion of the electronic cigarette 20 comprises sections of the outer wall 65, the inner wall 63, and the liquid reservoir 64, as well as the wick 66 and vaporizer (heating coil) 68. This portion of the electronic cigarette includes the part of the inner wall 63 comprising the openings 67 through which the wick 66 passes so that the ends of the wick extend into the liquid reservoir 64.

As noted above, in accordance with certain embodiments of the disclosure a collar is mounted around the wick 66 where it passes through each of the openings 67 in the wall 63 of the reservoir 64. In the example of FIG. 6, the respective collars each comprise a tubular element 100. The tubular elements 100 can be seen in cross-section in the main part of FIG. 6 where they are mounted around the wick 66, and a schematic representation of one of the collars in isolation is shown in perspective view towards the top right of FIG. 6. In this example each collar 100 has a circular cross section and is defined by a wall having an inner diameter which is a little less, e.g. around 10% less, than the nominal outer diameter of the wick 66. Thus when each collar 100 is slid over the wick during manufacture, the wick is slightly compressed at the location of the collars for example so that its cross-sectional area is reduced by perhaps 15% to 25% or so. The amount of compression may be different in different implementations. For example, in some cases there may be no compression such that the inner diameter of the collar 100 is a close match to the nominal diameter of the wick, and in other cases there may be more than 25% compression. The amount of compression may be selected to establish an appropriate compromise between helping to ensure there is a desired degree of sealing between the outer surface of the wick and the inner wall of the collar without unduly restricting fluid flow along the length of the wick. An appropriate degree of compression may, for example, be determined through empirical testing. Because in accordance with the example approach represented in FIG. 6 the collar is provided by a single component, the size of the hole through which the wick passes can be more reliably controlled as compared to conventional electronic cigarettes in which the size of the opening through which the wick passes may depend on the fit between multiple components.

For the sake of providing a concrete example, it is assumed for the implementation represented in FIG. 6 that the wick has a nominal diameter of 2 mm, and each collar 100 has an inner diameter of around 1.8 mm, an outer diameter of around 2.5 mm (i.e. wall thickness around 0.7 mm) and a length of around 2 mm, while the thickness of the wall 63 in the vicinity of the opening 67 through which the wick passes into the reservoir is around 1.8 mm. However, it will be appreciated the specific sizes may vary for different implementations. For example, in a relatively high power electronic cigarette that is able to generate a relatively large amount of vapor, a larger wick, and hence larger collars, may be used to help maintain a sufficient supply of liquid to the vaporizer. Conversely, in a relatively low power electronic cigarette that generates a relatively small amount of vapor, a smaller wick, and hence smaller collars, may be considered more appropriate. For the example represented in FIG. 6 it is assumed the respective collars are formed of a relatively rigid plastics material, for example polypropylene, but in other examples the collars may be formed from another material, for example a rigid material such as metal or glass or a resilient (compressible) material such as rubber or silicone.

The openings 67 in the inner wall 63 represented in FIG. 6 may be provided in accordance with any of the example approaches represented in FIGS. 3 to 5, or indeed in accordance with any known approaches for providing a corresponding structural part in other electronic cigarette implementations. The openings 67 have a shape matched to the outer profile of the respective collars 100 (i.e. in this example circular), and may be sized to be slightly smaller than the outer size of the collars, for example by around 10% or so, such that the inner surface defining the openings 67 is pressed against the outer surface of the collar when the electronic cigarette is assembled to help form a reliable seal between them. Significantly, because the wick 66 is to some extent protected from compression by the collar 100, a relatively tight fit between the inner wall and the collar may be provided to help provide a reliable seal with a reduced risk of overly compressing the wick as compared to conventional approaches without the collars. In examples where the openings 67 are undersized relative to the collars 100, a degree of resilience may be provided in the collar or in the wall around the openings 67 to accommodate the mismatch in size and to in effect provide the biasing force which helps form the seal between these components.

The collars may be formed using conventional manufacturing techniques having regard to the material from which they are made in any given implementation, for example using plastic molding techniques for the example discussed above with reference to FIG. 6. In a tubular collar of the kind discussed above with reference to FIG. 6, the collar may instead be provided by a flexible material that is wrapped around the wick during assembly, for example a cellophane material.

Apart from the modifications associated with the introduction of the collars 100, the electronic cigarette 20 may be otherwise conventional, both in terms of its structural configuration and functional operation.

Figure 7:
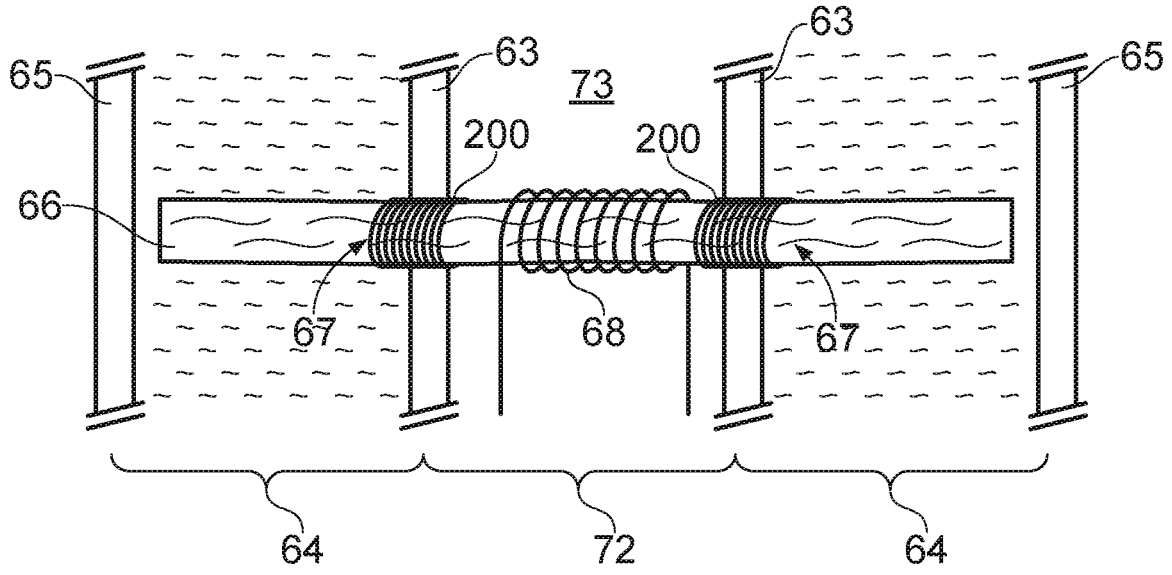

FIG. 7 schematically shows a cross-section of a portion of the electronic cigarette/vapor provision system 20 in the vicinity of its vapor generation chamber 73 in accordance with another example embodiment. Various aspects of FIG. 7 are similar to, and will be understood from, corresponding aspects of FIG. 6 and are not described in detail again in the interest of brevity. However, whereas in the example of FIG. 6 each collar comprises a tube 100 fitted around the liquid transport element 66, in the example of FIG. 7, each collar comprises a section of coil 200 wound around the liquid transport element. This coil may, for example, be formed of metal wire, for example the respective coils providing the collars 200 (which may be referred to as collar coils 200) may comprise the same material as used for the heating coil 68, for example a Nickel-Chrome, or other, alloy. The collar coils 200 may be wrapped around the wick to provide a collar with a geometry similar to that discussed above with reference to FIG. 6, and in that regard may in effect function in the same way as the collars 100 of FIG. 6.

Figure 8:
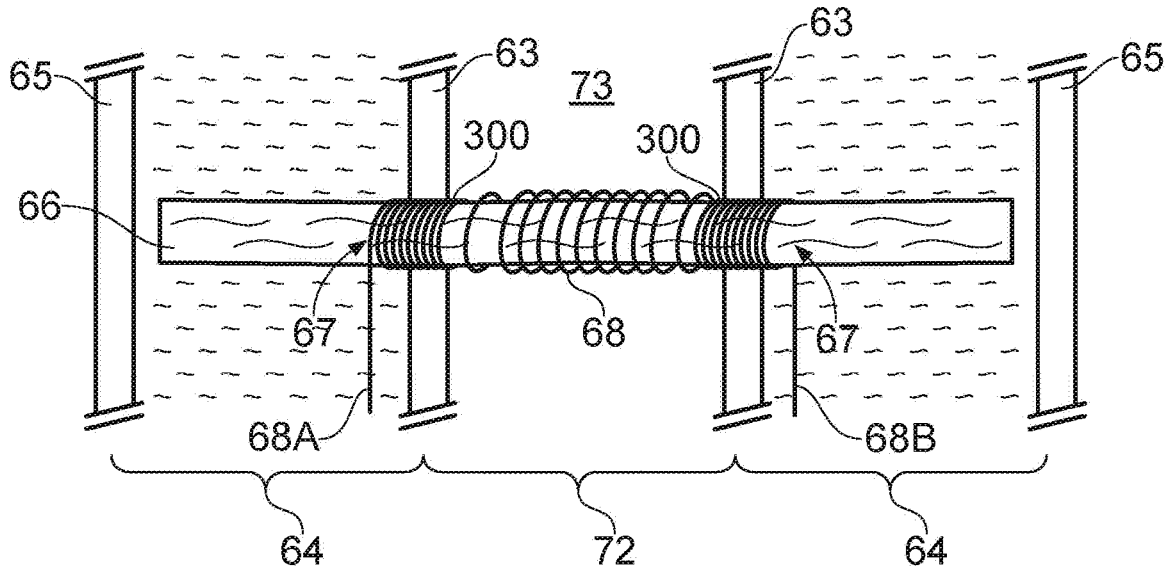

FIG. 8 schematically shows a cross-section of a portion of the electronic cigarette/vapor provision system 20 in the vicinity of its vapor generation chamber 73 in accordance with another example embodiment. Various aspects of FIG. 8 are similar to, and will be understood from, corresponding aspects of FIGS. 6 and 7 and are not described in detail again in the interest of brevity. However, whereas in the example of FIG. 7 each collar comprises a coil 200 wrapped around the liquid transport element 66 which is separate from the vaporizer heater coil 68, in the example of FIG. 8, each collar again comprises a section a section of coil 300 wound around the liquid transport element, but in this example the coil collars 300 and the heater coil 68 are provided by a single wire. In the example of FIG. 8, leads 68A, 68B for providing an electrical connection to the coil around the wick are schematically shown as passing through the liquid reservoir 64, and in this case they may exit the reservoir through a suitably sealed port (not shown). However, in another example, the leads may return back through the respective openings 67 and lead away from the wick within the air channel 72 in the conventional manner. It is known for the leads connecting to a heater coil in an electronic cigarette to have a lower electrical resistance per unit length than the heater coil itself to reduce the amount of heat generated in the leads. This may be achieved, for example, by the leads and the coil being made of different metals (or the same metal with different cross-sections) which are connected together (e.g. by soldering). In an approach of the kind represented in FIG. 8 it may similarly be appropriate for the collar coils 300 to comprise a material having lower resistance per unit length than the heater coil 68 to avoid excess heating of the collar coils 300 during use. That is to say, the collar coils 300 may in effect be provided by a part of the lead wires for the heater coil 68 rather than as an extension of the heater coil. In another approach to reduce the amount of heat generated by the collar coils, a single resistance coil may be used to provide the collar coils and the heating coil, but the electrical connection leads to the battery may simply be configured to connect across only a central portion of the coil so that current flow (and hence electrical heating) is restricted to this portion only. The collar coils 200 may again be wrapped around the wick to provide a collar with a geometry similar to that discussed above with reference to FIG. 6, and in that regard may again provide the same functions as the collars 100 of FIG. 6.

Figure 9:
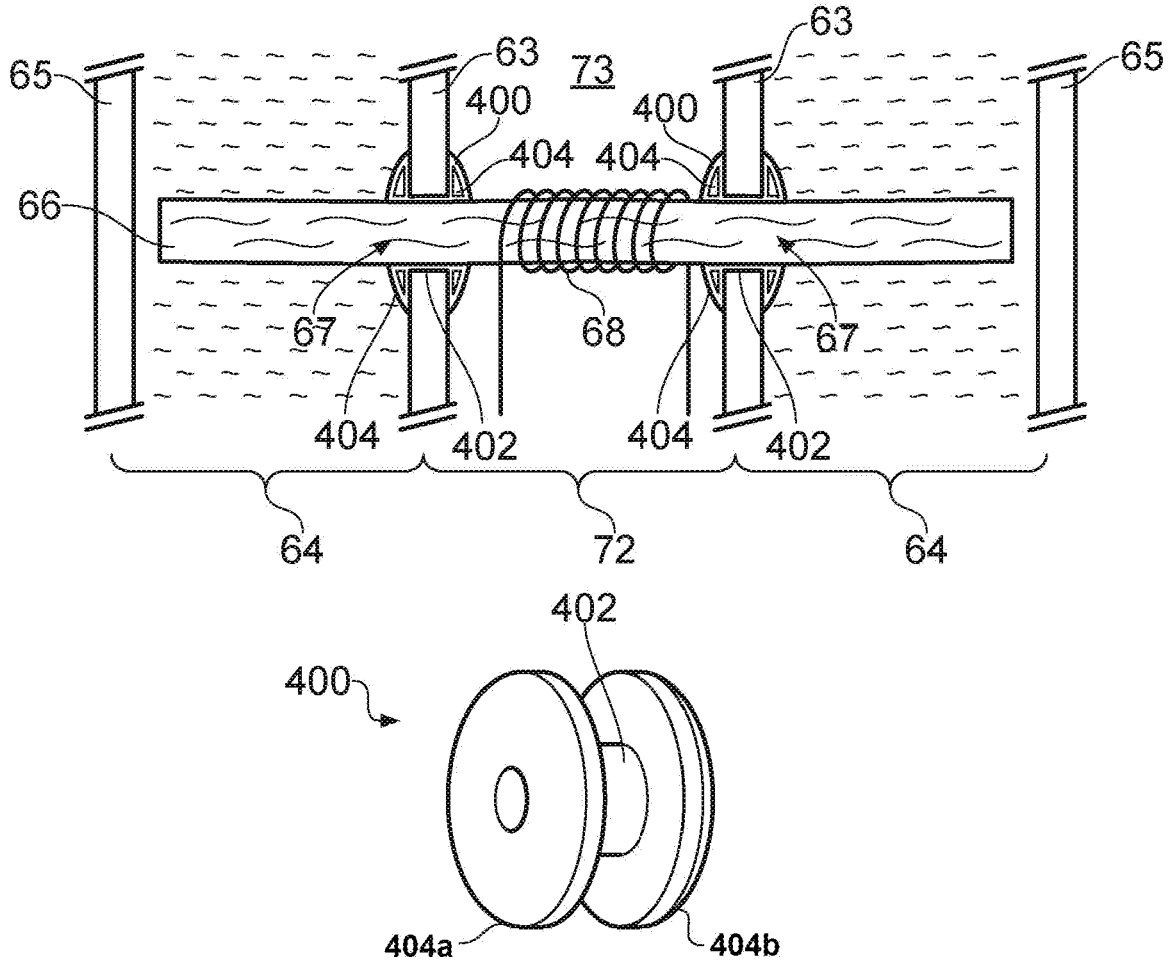

FIG. 9 schematically shows a cross-section of a portion of the electronic cigarette/vapor provision system 20 in the vicinity of its vapor generation chamber 73 in accordance with another example embodiment. Various aspects of FIG. 9 are similar to, and will be understood from, corresponding aspects of FIG. 6 and are not described in detail again in the interest of brevity. However, whereas in the example of FIG. 6 each collar comprises a straight-forward tube 100 fitted around the liquid transport element 66, in the example of FIG. 7, each collar 400 comprises a tube section 402 mounted around the liquid transport element, but also includes at each end of the tube section 402 a flange 404 arranged to seal to the surfaces of the wall of reservoir around the opening on either side of the wall, wherein a first flange 404*a* seals the surfaces of the wall around the opening on a first side of the wall and a second flange 404*b* seals the surfaces of the wall around the opening on a second side of the wall. The collars 400 are shown fitted to the wick in cross-section in the main part of FIG. 9 while a schematic representation of one of the collars 400 in isolation is shown in perspective view towards the bottom right of FIG. 9. Although in this example each collar 400 comprises a flange 404 at either end, it will be appreciated in some examples a flange may be provided at only one end, for example the end of the collar within the liquid reservoir.

In this example each collar 400 is circularly symmetric and made of a resilient material, such as rubber or silicone. The tubular section 402 has a circular cross section and is defined by a wall having an inner diameter which is a little less, e.g. around 10% less, than the nominal outer diameter of the wick 66. Thus when each collar 400 is mounted to the wick, the wick is slightly compressed at the location of the collars, for example so that its cross-sectional area is reduced by perhaps 15% to 25% or so. As for the other example embodiments shown in FIGS. 6 to 8, The amount of compression may be different in different implementations. For example, in some cases there may be no compression such that the inner diameter of the collar 400 is a close match to the nominal diameter of the wick, and in other cases there may perhaps be more than 25% compression. The amount of compression may be selected to establish an appropriate compromise between helping to ensure there is a desired degree of sealing between the outer surface of the wick and the inner wall of the collar without unduly restricting fluid flow along the length of the wick. An appropriate degree of compression may, for example, be determined through empirical testing.

For the sake of providing a concrete example, it is assumed for the implementation represented in FIG. 9 that the wick has a nominal diameter of 2 mm and each collar 400 has a through passage for the wick with a diameter of around 1.8 mm and the tubular section 402 has an outer diameter of around 2.8 mm (i.e. the tubular section wall thickness is around 1 mm). When each collar 400 is in its rest state (i.e. its initially manufactured state/state before being assembled into the electronic cigarette), the gap between the flanges 404 is in this example around 0.95 mm, whereas the thickness of the reservoir wall 63 around the openings 67 a little larger, in this example around 1 mm. This means when each collar 400 is located in its respective opening, the flanges are distorted/deformed away from their initially manufactured state/rest position to accommodate the thickness of the reservoir wall which, for a resilient material, results in the flanges been biased against the surface of the reservoir wall around the opening, which helps to form a seal. In this example, the flanges are assumed to have an outer diameter of around 4 mm, and a thickness of around 1 mm. However, and as already noted above for the other examples embodiments, it will be appreciated the specific sizes may vary for different implementations.

As for the examples represented in FIGS. 6 to 8, the openings 67 in the inner wall 63 represented in FIG. 9 may be provided in accordance with any of the example approaches represented in FIGS. 3 to 5, or indeed in accordance with any known approaches for providing this structural part of an electronic cigarette. In cases where the surface of the wall around the opening is not generally flat (for example due to the slots which form the opening is in the example of FIG. 4B), the inner surface of the respective flanges (i.e. the surfaces which makes to the reservoir wall) may be correspondingly profiled.

The openings 67 in FIG. 9 may again have a shape matched to the outer profile of the tubular sections 402 of the respective collars 400 (i.e. in this example circular), and may again be sized to be slightly smaller than the outer size of the tubular sections of the collars, for example by around 10% or so, such that there is a biasing force urging the inner surface defining the openings 67 and the outer surface of the collars together when the electronic cigarette is assembled to help form a reliable seal between them. The collars may be formed using conventional manufacturing techniques having regard to the material from which they are made in any given implementation, for example using silicone or rubber molding techniques for this example.

The collars 400 may comprise standalone elements that are threaded onto the wick during assembly, but in some cases it may be preferable for the collars to be integrally formed with the wick, for example using over-molding techniques in which the collars are formed by conventional compression molding with the wick in place in the mold.

While the above-described embodiments have in some respects focused on some specific example vapor provision systems, it will be appreciated the same principles can be applied for vapor provision systems using other technologies. That is to say, the specific manner in which various aspects of the vapor provision system function are not directly relevant to the principles underlying the examples described herein.

For example, whereas the above-described embodiments have primarily focused on aerosol provision systems comprising a vaporizer comprising a resistance heater coil, in other examples the vaporizer may comprise other forms of heater, for example a planar heater, in contact with a liquid transport element. Furthermore, in other implementations a heater-based vaporized might be inductively heated. In yet other examples, the principles described above may be adopted in devices which do not use heating to generate vapor, but use other vaporization technologies, for example piezoelectric excitement.

Furthermore, and as already noted, whereas the above-described embodiments have focused on approaches in which the aerosol provision system comprises a two-part device, the same principles may be applied in respect of other forms of aerosol provision system which do not rely on replaceable cartridges, for example refillable or one-time use devices.

Thus there has been described a vapor provision system comprising: a reservoir containing liquid for vaporization; a vaporizer; a liquid transport element arranged to transport liquid from the reservoir to the vaporizer for vaporization to generate a vapor for user inhalation, wherein the liquid transport element extends into the reservoir through an opening in a wall of the reservoir; and a collar mounted around the liquid transport element where it passes through the opening in the wall of the reservoir.

The vapor provision system may, for example, be manufactured/assembled by: providing a liquid transport element; mounting a collar around the liquid transport element; providing a reservoir for containing liquid for vaporization; and arranging the liquid transport element so it extends into the reservoir through an opening in a wall of the reservoir such that the collar is mounted to the liquid transport element where the liquid transport element passes through the opening in the wall of the reservoir.

In order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention(s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein, and it will thus be appreciated that features of the dependent claims may be combined with features of the independent claims in combinations other than those explicitly set out in the claims. The disclosure may include other inventions not presently claimed, but which may be claimed in future.

The invention claimed is:

1. A vapor provision system comprising:

a reservoir containing liquid for vaporization;

a vaporizer;

a liquid transport element arranged to transport liquid from the reservoir to the vaporizer for vaporization, wherein the liquid transport element extends into the reservoir through an opening in a wall of the reservoir; and a collar mounted around the liquid transport element where the liquid transport element passes through the opening in the wall of the reservoir, the collar comprising a first flange arranged to seal to a first surface of the wall of the reservoir around the opening.

2. The vapor provision system of claim 1, wherein the collar comprises a second flange arranged to seal to a second surface of the wall of reservoir around the opening.

3. The vapor provision system of claim 2, wherein a gap between the first flange and the second flange when the collar is in an initially-manufactured state is less than a thickness of the wall of the reservoir around the opening.

4. The vapor provision system of claim 1, wherein the collar comprises a resilient material.

5. The vapor provision system of claim 1, wherein the collar comprises a flexible material wrapped around the liquid transport element.

6. The vapor provision system of claim 4, wherein the resilient material comprises at least one of rubber or silicone or cellophane.

7. The vapor provision system of claim 1, wherein the collar comprises a rigid material.

8. The vapor provision system of claim 1, wherein the collar is integrally molded to the liquid transport element.

9. The vapor provision system of claim 1, wherein the collar comprises a tube fitted around the liquid transport element.

10. The vapor provision system of claim 1, wherein the collar comprises a coil wound around the liquid transport element.

11. The vapor provision system of claim 10, wherein the vaporizer comprises a heating coil wound around the liquid transport element, and wherein the heating coil and the collar coil are provided by a single wire.

12. The vapor provision system of claim 10, wherein the vaporizer comprises a heating coil wound around the liquid transport element, and wherein the heating coil and the collar coil are separate from one another.

13. The vapor provision system of claim 1, wherein the liquid transport element comprises a plurality of fibers.

14. The vapor provision system of claim 13, wherein the plurality of fibers comprises at least one of glass fibers or cotton fibers.

15. The vapor provision system of claim 1, wherein the collar has a through hole for the liquid transport element which is smaller than the liquid transport element in an uncompressed state such that the liquid transport element is compressed by the collar mounted around the liquid transport element.

16. The vapor provision system of claim 15, wherein the liquid transport element is compressed by the collar by an amount that reduces the cross-sectional area of the liquid transport element relative to the uncompressed state by between 0% and 25%.

17. The vapor provision system of claim 1, wherein the opening in the reservoir wall is smaller than an outer size of the collar so that the reservoir wall around the opening applies a biasing force to the collar.

18. The vapor provision system of claim 1, wherein the vapor provision system is a cartridge configured to be coupled to a vapor provision system control unit for use.

19. Vapor provision means comprising:

reservoir means for containing liquid for vaporization;

vaporizer means;

liquid transport means for transporting liquid from the reservoir means to the vaporizer means for vaporization, wherein the liquid transport means extends into the reservoir means through opening means in a wall of the reservoir means; and collar means comprising a first flange arranged to seal to a first surface of the wall of the reservoir means around the opening means and the collar means mounted around the liquid transport means where the liquid transport means passes through the opening means in the wall of the reservoir means.

20. A method of assembling a vapor provision system, comprising:

providing a liquid transport element;

mounting a collar comprising a first flange around the liquid transport element;

providing a reservoir for containing liquid for vaporization; and arranging the liquid transport element so the liquid transport element extends into the reservoir through an opening in a wall of the reservoir such that the collar is mounted to the liquid transport element where the liquid transport element passes through the opening in the wall of the reservoir such that the first flange is arranged to seal to a first surface of the wall of the reservoir around the opening.

* * * * *